US006858291B2

(12) United States Patent
Sakuma et al.

(10) Patent No.: US 6,858,291 B2
(45) Date of Patent: Feb. 22, 2005

(54) ELASTIC BELT FOR PAPERMAKING CALENDER

(75) Inventors: Norio Sakuma, Tokyo (JP); Yasuhiro Tsutsumi, Tokyo (JP); Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 35 days.

(21) Appl. No.: 10/208,725

(22) Filed: Jul. 29, 2002

(65) Prior Publication Data

US 2003/0024675 A1 Feb. 6, 2003

(30) Foreign Application Priority Data

Jul. 31, 2001 (JP) ..... 2001-232598

(51) Int. Cl.[7] ..... B32B 27/00

(52) U.S. Cl. ..... 428/319.3; 428/314.4; 428/314.8; 428/212; 428/217

(58) Field of Search ..... 428/315.5, 315.7, 428/304.4, 319.3, 316.6, 314.4, 314.8, 217, 212; 162/358.2–358.5; 100/151

(56) References Cited

U.S. PATENT DOCUMENTS 4,552,620 A * 11/1985 Adams ..... 162/358.4
5,549,968 A * 8/1996 Byers et al. ..... 442/70
5,836,242 A * 11/1998 Aberg ..... 100/327
6,331,231 B1 * 12/2001 Inoue ..... 162/358.4
6,455,606 B1 * 9/2002 Kaku et al. ..... 521/170
6,616,814 B2 * 9/2003 Best ..... 162/358.4

FOREIGN PATENT DOCUMENTS

JP 60-88193 5/1985
JP 10-501852 2/1998

* cited by examiner

*Primary Examiner*—Terrel Morris
*Assistant Examiner*—Hai Vo
(74) *Attorney, Agent, or Firm*—Howson and Howson

(57) ABSTRACT

To address the conflict between structural strength and flexibility in a conventional elastic belt for a papermaking calender, and to reduce manufacturing time, a belt in which the paper sheet-facing side of a base body side is covered by a high molecular weight elastic layer, is characterized in that the high molecular weight elastic layer is composed of a dense, first high molecular weight elastic layer and a second, high molecular weight elastic layer having a multitude of small voids of almost the same size. Flexibility of the layer having small voids is achieved while the dense surface layer is adapted to the ruggedness of the paper sheet.

9 Claims, 7 Drawing Sheets

FIG.7

| Example/ Comparative example | High molecular weight elastic member | Resin | Hard-ness | Form of small voids | Bonding surface | Calender effects | Com-pression fatigue | Flex fatigue | Overall evaluation |
|---|---|---|---|---|---|---|---|---|---|
| Example 1 | First layer | Polyurethane | 90° | – | Upper side of base body | Fair | Excellent | Excellent | Excellent |
| | Second layer | Polyurethane | 85° | Hollow microcapsules 2 wt % | | | | | |
| | Third layer | Polyurethane | 90° | – | | | | | |
| Example 2 | First layer | Polyurethane | 85° | – | Upper side of base body | Excellent | Good | Good | Excellent |
| | Second layer | Isoprene rubber | 80° | Hollow microcapsules 2 wt % | | | | | |
| | Third layer | Polyurethane | 85° | – | | | | | |
| Example 3 | First layer | Polyurethane | 85° | – | Upper side of base body | Excellent | Fair | Fair | Good |
| | Second layer | Isoprene rubber | 80° | Closed bubbles void content 15 % | | | | | |
| | Third layer | Polyurethane | 85° | – | | | | | |
| Example 4 | First layer | Polyurethane | 90° | – | Middle of base body | Fair | Excellent | Good | Good |
| | Second layer | Polyurethane | 85° | Hollow microcapsules 2 wt % | | | | | |
| | Third layer | Polyurethane | 90° | – | | | | | |
| Example 5 | First layer | Polyurethane | 90° | – | Upper side of base body | Good | Good | Good | Good |
| | Second layer | Polyurethane | 85° | Hollow microcapsules 2 wt % | | | | | |
| | Third layer | Polyurethane | 90° | – | | | | | |
| Comparative example 1 | First layer | Polyurethane | 90° | – | Middle of base body | Not good | Excellent | Excellent | Not good |
| | Second layer | Polyurethane | 85° | – | | | | | |
| | Third layer | Polyurethane | 90° | – | | | | | |

ELASTIC BELT FOR PAPERMAKING CALENDER

FIELD OF THE INVENTION

This invention relates to an elastic belt for a papermaking calender, and to improvements in the durability of the belt and in the smoothness of the surface of the paper produced.

BACKGROUND OF THE INVENTION

In conventional papermaking, a calendering process is carried out in order to improve the smoothness of the surface of the paper being produced. There are various types of calendering apparatus. Typical calendering apparatuses include the machine calender, in which the nip is composed of a pair of steel rolls, and the super calender in which the nip is composed of a steel roll and an elastic roll, the steel roll being covered by an elastic cover.

In the machine calender, the hard steel rolls apply pressure at the nip along a narrow line, and a relatively high pressure is applied where the density of the paper is high. As a result, an undesirable change in the density of the paper occurs, which may be detrimental to the uniformity of printing on the paper. The super calender solves the shortcomings of the machine calender to some extent, since the width of the nip is broadened due to the effect of the elastic cover. However, heat, which accumulates between the elastic cover and the roll, is detrimental to the durability of the cover, and, as a result, the cover has a tendency to flake off the roll.

Recently, a calender apparatus using an endless belt comprising an elastic material was proposed to solve the problems of the machine calender and the super calender. Representative examples are shown in FIGS. 8 and 9.

In the calender apparatus shown in FIG. 8, a paper sheet W, which is placed on an elastic belt 1, is passed through the nip Pa formed between upper and lower steel rolls P1 and P2. The elastic belt 1 is an endless belt, which follows a path around roll P2, the path being relatively long compared to the circumference of roll P2. The upper roll P1 is heated by a heating apparatus (not shown). When the paper sheet W on the upper surface of the long elastic belt reaches the nip Pa and is sandwiched by the upper and lower rolls P1 and P2, its first surface W1, which is in contact with the press roll P1, is made smooth, but the second surface W2, which is in contact with the long elastic belt 1, is not made as smooth as the first surface W1, due to the effect of the surface of the belt. The density of the paper sheet W will not change greatly, and the paper sheet will have a surface suitable for printing. If a high smoothness is also necessary on the second surface W2 of the paper sheet W, it may be achieved by using another calender apparatus which does not use the elastic belt 1.

In a calender apparatus shown in FIG. 9, a paper sheet W, which is placed on a relatively short elastic belt 1, is passed through the nip part Pb formed between a steel roll P3 and a press shoe S. The short elastic belt 1 is an endless belt which travels around the press shoe P2 in a relatively short path. A lubricant is supplied to the inside surface of the belt 1 from time to time.

The calendered effect on the first surface W1, which contacts the steel roll P3 at the nip Pb, is no different from the effect achieved in the apparatus of FIG. 8. However, the smoothness of the second surface W2, which contacts with the elastic belt 1, may be superior to the smoothness of the corresponding surface of the paper calendered by the apparatus of FIG. 8, since the width of the pressurizing nip Pb may be larger where a press shoe is used. The calender apparatus shown in FIG. 9, in which the nip is formed by a press shoe, also has the advantage that it is easier in such an apparatus to prevent dispersion of oil supplied to the inside of the elastic belt. In a calender apparatus such as shown in FIG. 8, preventing dispersion of oil is more difficult.

Two characteristics, in particular, are demanded in an elastic belt used in both kinds of calender. One characteristic is flexibility of the high molecular weight elastic layer on the side which contacts the paper sheet. The other characteristic is durability of the part of the belt which is in contact with the press side. Proposals made in the past to meet these demands include, for instance, the proposal disclosed in unexamined PCT National Phase Publication No. 501852/1998 and the proposal disclosed in Japanese unexamined Patent Publication No. 88193/1985. Unexamined PCT National Phase Publication No. 501852/1998 discloses the elastic belt shown in FIG. 10, and Japanese unexamined Patent Publication No. 88193/1985 discloses of another elastic belt shown in FIG. 11.

The elastic belt 1', shown in FIG. 10, has a base body 2 to impart strength to the belt as whole, a high molecular weight elastic layer 3 on the paper sheet side, which covers the paper sheet side 2*a* of the base body, and a high molecular weight elastic layer 4 on the press side, which covers the press side 2*b* of the base body opposite to the side 2*a,* the press side being the side facing a press roll or press shoe. The base body 2 is composed of a warp and a weft. In addition, to meet the above-mentioned demands, the high molecular weight elastic layer 3 of the paper sheet side is made flexible, and the high molecular weight elastic layer 4 of the press side is formed with a hardness higher than that of the high molecular weight elastic layer 3 on the paper sheet side. Thus, the layer 3 on the paper sheet side of the belt 1 is capable of adapting to the ruggedness of the paper sheet flexibly, and the press side layer 4 contributes to improved durability.

The elastic belt 1", shown in FIG. 11, has a high molecular weight elastic layer 3' which covers the paper sheet side 1*a* of a base body 2. The base body 2, which comprises a woven fabric having a warp and weft, is exposed on the press side 1*b*. The base body 2 imparts strength to the elastic belt 1". The high molecular weight elastic layer 3' forming the paper sheet side, has dispersed bubbles 5, and is produced by spreading a resin material on the base body 2 by spraying.

In the case of the conventional elastic belt 1' shown in FIG. 10, the flexible cushion properties are brought into full play only by the properties of the resin of the high molecular weight elastic layer 3 on the paper sheet side. The structural strength of the belt is likely to become insufficient, and there is a possibility that elongation and breakage will occur. There is also the possibility that the elastic layer 3 on the paper sheet side will peel off the base body 2.

On the other hand, although flexibility may be achieved by the bubbles contained in the layer 3' in the elastic belt 1" shown in FIG. 11, this belt also has drawbacks. The manufacturing process is time-consuming, since the bubbles are produced by a spray jet. There is also the problem that the bubbles which are generated in the liquid plastic material are subject to shrinkage and are not stable in size.

An object of this invention is to solve the various problems of conventional elastic belts discussed above, and to provide an elastic belt which has superb flexibility and cushioning properties, making it especially suitable for use in a papermaking calender.

SUMMARY OF THE INVENTION

To address the problems discussed above, the elastic papermaking calender belt in accordance with the invention comprises a base body having a paper sheet side and a press side opposite to the paper sheet side, and a high molecular weight elastic layer covering the paper sheet side of the base body, the high molecular weight elastic layer being composed of a dense, first, high molecular weight elastic layer, and a second, high molecular weight, elastic layer having a multitude of small voids, the voids in the second layer being of almost the same size. Thus constructed, the belt has improved flexibility in its interior, while having a dense surface layer adapted to the ruggedness of the paper sheet.

The voids may comprise a hollow filler or hollow microcapsules mixed with the second high molecular weight elastic layer. Alternatively, the voids may be composed of bubbles fed into the material of the second high molecular weight elastic layer by a bubble mixer. As a further alternative, the bubbles may be produced by the action of a foaming agent mixed with the material of the second high molecular weight elastic layer.

Preferably, the first high-molecular weight elastic layer has a hardness of 85 to 95° (JIS-A), and the second high molecular weight elastic member has a hardness which is equal to that of the first high molecular weight elastic layer or a hardness in the range of 80 to 85° (JIS-A), in order to achieve a balance between the hardness of the surface layer and the hardness of the interior of the belt.

The press side of said base body may be exposed for reduced manufacturing cost, or covered by a third high molecular weight elastic layer, the third layer, preferably having a hardness of 85 to 95° (JIS-A), for improved durability of press side of the belt, and impermeability to oil supplied to the inside of the belt.

BRIEF DESCRIPTION OF THE DRAWINGS

FIG. 7 is a table, showing the evaluation of five examples of an elastic belt according to the invention and a comparative example;

DETAILED DESCRIPTION OF THE PREFERRED EMBODIMENTS

Figure 1:
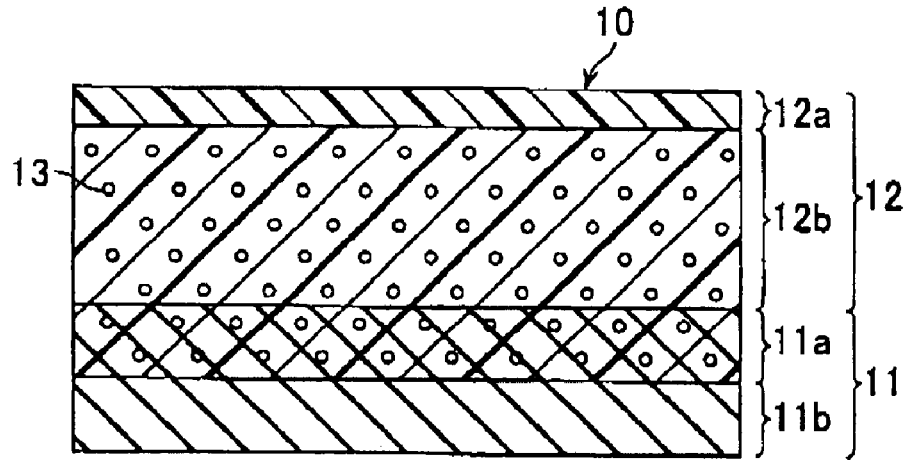
FIG. 1 is an enlarged cross-sectional view showing a first embodiment of an elastic belt according to the invention.

In an elastic belt 10 according to the invention, as shown in FIG. 1, a layer 11*a,* which is on the paper sheet of a base body 11, is covered by a high molecular weight elastic layer 12. The high molecular weight elastic layer 12 has a dense, first, high molecular weight elastic layer 12*a* as a surface layer, and a second high molecular weight elastic layer 12*b,* having a multitude of small voids 13 of almost the same size. The base body 11 remains exposed on the press side 11*b* of the base body, i.e., the side which is in contact with a press roll, a press shoe, or the like.

Figure 2:
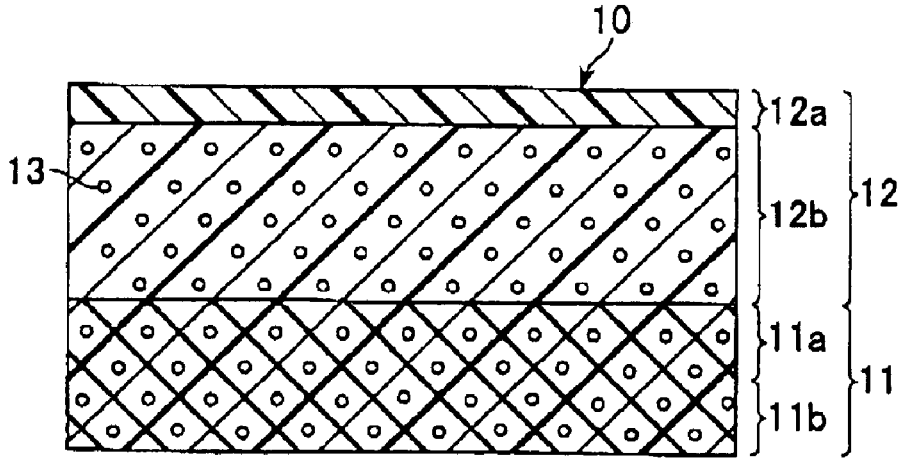
FIG. 2 is an enlarged cross-sectional view showing a second embodiment of an elastic belt according to the invention.

As shown in FIG. 2, when the second high molecular weight elastic layer 12*b* is formed, the press side 11*b* of the base body 11 may be coated with the same resin material. In this case, small voids 13, which are contained in the second high molecular weight elastic layer 12*b,* are also contained in the resin on the press side 11*b* of the base body 11. Thus there is a case in which the press side of the base body contains small voids, and another case in which the press side does not contain small voids.

The base body 11 imparts strength to the whole elastic belt 10. The base body 11 may comprise a woven fabric having a warp and weft, each in a desired structure. Alternatively, the base body may comprise a fabric in which a warp and weft, instead of being woven, only cross each other in overlapping relationship. Another alternative is a base body in which a thin belt is partly superposed by a spiral winding in the direction of its width. Various structures are possible, including other members which have strength in the directions of length and width. A filling yarn may be preliminarily inserted into the middle part of a base body 11 in the direction of its thickness, so that a resin layer on the paper sheet side and a resin layer on the press side may become integrally bonded to the middle part.

The high molecular weight elastic member 12 of the base body 11 on the paper sheet side has its first high molecular weight elastic layer 12*a* forming a surface layer, and its second high molecular weight elastic layer 12*b* forming a middle layer. The first high molecular weight elastic layer 12*a* is for the purpose of making the surface of the paper smooth, and is a dense layer having no voids. On the other hand, the second high molecular weight elastic layer 12*b* is a flexible layer, having a multitude of small voids 13 of almost the same size. Therefore, in an elastic belt 10 according to the invention, the second layer, which is an interior layer, exhibits well-balanced cushion properties, the surface layer exhibits adaptability to the ruggedness of the paper sheet, and at the same time prevents transcription of marks to the paper sheet due to the small voids 13 which are contained in the middle layer.

Formation of the first high molecular weight elastic layer 12*a,* which is a dense layer having no voids, contributes to increased hardness of the elastic belt 10. As the first high molecular weight elastic layer 12*a* is a very thin layer, having a thickness of 1 mm or less, an increase in the ratio of the thickness of layer 12*a* to the thickness of layer 12*b* results in increased structural hardness of the elastic belt 10. Polyurethane resin, which has excellent smoothness, is suitable as a resin for layer 12*a*. It has been found that the surface roughness should be held within 20 $\mu$m. In addition, the hardness of the resin used in the first high molecular weight elastic layer 12*a* should be in the range of 85 to 95° (JIS-A).

The second high molecular weight elastic layer 12*b,* having the multitude of small voids 13, contributes to increased flexibility of the elastic belt 10. Therefore, increasing the ratio of the thickness of layer 12*b* to the thickness of layer 12*a* results in increased flexibility. Polyurethane resin and isoprene rubber, etc. are suitable resins for the formation of the second layer 12*b*. It is desirable that the hardness of the resin used in the second high molecular weight elastic layer 12*b* be equal to or lower than that of the first high molecular weight elastic layer 12*a* for improved cushion properties of the elastic belt 10 as a whole. For example, a hardness of 80 to 85° (JIS-A) is suitable for the second high molecular weight elastic layer 12*a*.

Figure 3:
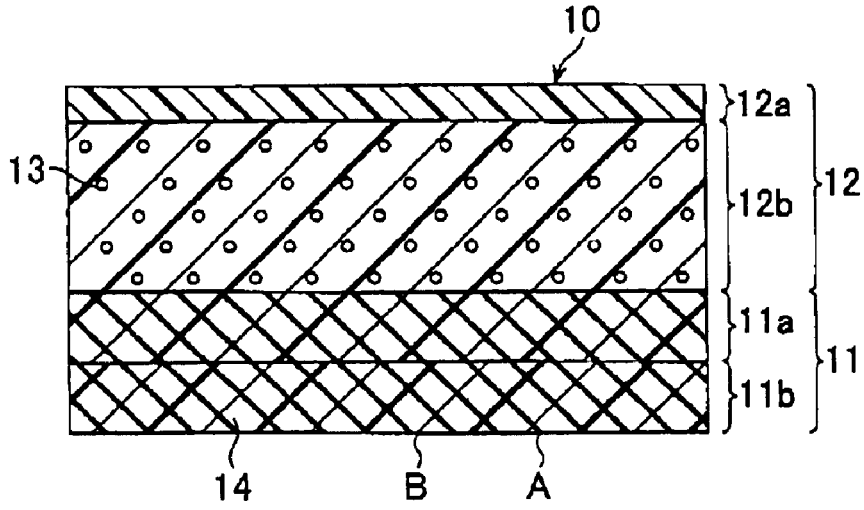
FIG. 3 is an enlarged cross-sectional view showing a third embodiment of an elastic belt according to the invention.

In the elastic belt 10 according to the invention shown in FIG. 3 as well as the elastic belt 10 according to the invention shown in FIG. 1, a high molecular weight elastic layer 12, which covers the paper sheet side 11*a* of a base body 11, comprises a first high molecular weight elastic layer 12*a*, which becomes a dense surface, and a flexible, second high molecular weight elastic layer 12*b*, having a multitude of small voids 13 of almost the same size. The elastic belt 10 shown in FIG. 3, is characterized in that a press side layer 11*b* of the base body 11 is covered by a third high molecular weight elastic layer 14. Covering the press side 11*b* by the third high molecular weight elastic layer 14 improves durability as compared with the case where the press side is exposed, and meets the demand for impermeability to oil supplied to the inside of the belt. In the case of FIG. 3, the surface B of the third high molecular weight elastic member 14 coincides with the outer surface of the press side layer 11*b* of the base body 11.

Figure 4:
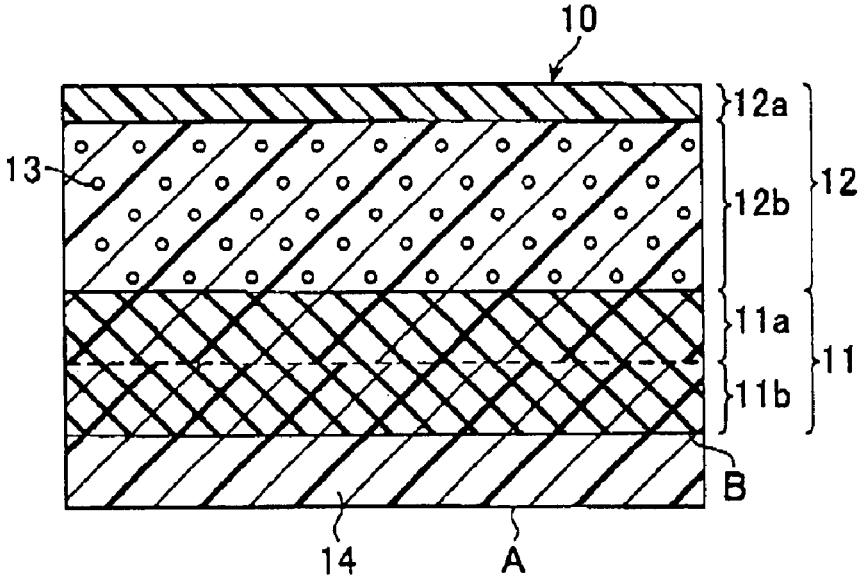
FIG. 4 is an enlarged cross-sectional view showing a fourth embodiment of an elastic belt according to the invention.

It is a common feature of the elastic belts 10 of FIGS. 3 and 4 that a high molecular weight elastic member 12, which covers a paper sheet side 11*a* of a base body 11, comprises a first high molecular weight elastic layer 12*a* which forms a dense surface and a flexible second high molecular weight elastic layer 12*b* which has a multitude of small voids 13 of almost the same size, and that a press side 11*b* of a base body 11 is covered by a third high molecular weight elastic member 14. However, the elastic belt shown in FIG. 4 is characterized in that an outer surface A of a third high molecular weight elastic layer 14 is outside the outer surface B on a press side 11*b* of the base body. This is effective in meeting the demand for flexibility of the high molecular weight elastic layer on the side which contacts the paper sheet, and durability of the press side.

Since the outer surface A of the third high molecular weight elastic layer 14, which covers the press side 11*b* of the base body, is a press side surface which contacts a component of calender apparatus such as a roll, cylinder, scraper, etc., and its wear resistance needs to be improved, it is preferable that the hardness of the outer surface be in the range of 85 to 95° (JIS-A). However, small voids may be formed in the third high molecular weight elastic layer 14, and the number, size and density of the voids may be adjusted to control the structural hardness of the layer 14.

The multitude of small voids 13 in the second high molecular weight elastic layer 12*b* is obtained by mixing into the resin hollow materials such as a hollow filler or microcapsules. It has been confirmed that the preferred diameter of these small voids 13 is in the range from 10 to 100 $\mu$m.

It has been confirmed experimentally that the void content in the second high molecular weight elastic layer 12*b* is preferably in the range of 2 to 30%. To achieve a void content in this range the amount of the microcapsules mixed into the resin should be in the range of 0.5 to 50 wt %.

It is acceptable that the small voids 13 be either bubbles mechanically mixed into the second high molecular weight elastic layer 12*b* by a bubble feeder (not shown), or bubbles which are obtained chemically by the foaming action of a foaming agent mixed with the resin. However, in either case, it is important in order to secure excellent cushion properties that the bubbles be of almost the same stable size. Products of stable quality may be provided especially when a hollow filler or hollow microcapsules are used.

Materials for the second high molecular weight elastic layer 12*b*, which has small voids 13, and the third high molecular weight elastic layer 14 on the press side, may be selected from among rubbers and other elastomers. Polyurethane resin is suitable, and, in view of its physical properties, thermosetting urethane resin is preferable.

Figure 5:
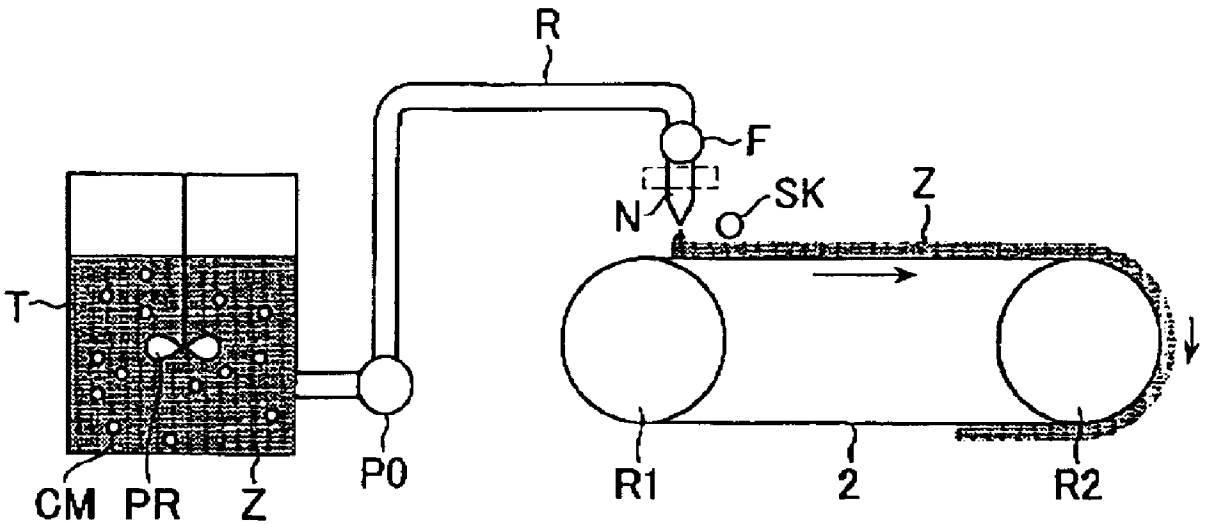
FIG. 5 is a cross-sectional view of an apparatus for manufacturing a long elastic belt according to the invention.

Next, the method of manufacturing an elastic belt 10 according to the invention will be explained with reference to FIG. 5. A hollow filler or hollow microcapsules CM are thrown into a tank T containing a high molecular weight elastic material Z, while an agitator PR in the tank is rotated and the microcapsules or hollow filler are evenly mixed with the elastic material Z. The high molecular weight elastic material Z, containing the hollow filler or hollow microcapsules CM, is sucked from the tank T by a pump PO and passed through a passage R, a traversing apparatus F, and a nozzle N. From the nozzle N, the mixture is spread evenly over a base body 11, which spans rolls R1 and R2 in an endless loop that runs continuously in the direction of the arrow. Excess high molecular weight elastic material thus spread is removed by a scraper SK.

After the second high molecular weight elastic layer 12*b*, made of high molecular weight elastic material Z containing a hollow filler or hollow microcapsules CM, is formed on the paper sheet side 11*a* of said base body 11, the layer 12*b* is heated and cured by a heating apparatus (not shown), and, when the desired hardness is achieved, the first high molecular weight elastic layer 12*a* is formed by spreading a high molecular weight elastic material without bubbles onto the layer 12*b* until a predetermined thickness is achieved. After heating and curing, the surface of layer 12*a* is ground to complete the formation of the elastic belt 10 according to the invention.

When it is desired to cover the press side 11*b* of the base body 11 with a third high molecular weight elastic material layer 14, the base body 11, along with the first and second high molecular weight elastic material layers 12*a* and 12*b*, is removed from the rolls R1 and R2, turned inside-out, and returned to the rolls. Thereafter, a high molecular weight elastic material, not containing bubbles, is spread over the base body on the press side and cured. Then, the high molecular weight elastic material layer 14 is completed by grinding its surface.

Figure 6:
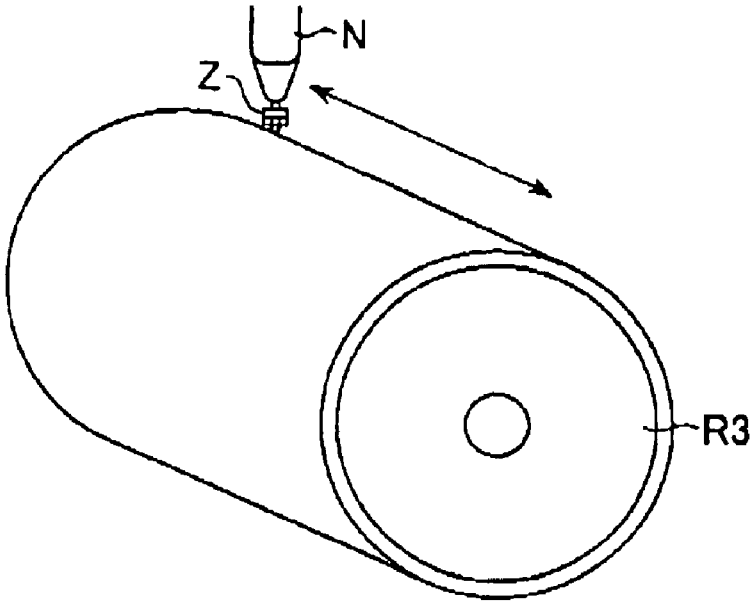
FIG. 6 is a cross-sectional view of an apparatus for manufacturing a short elastic belt according to the invention.
Figure 8:
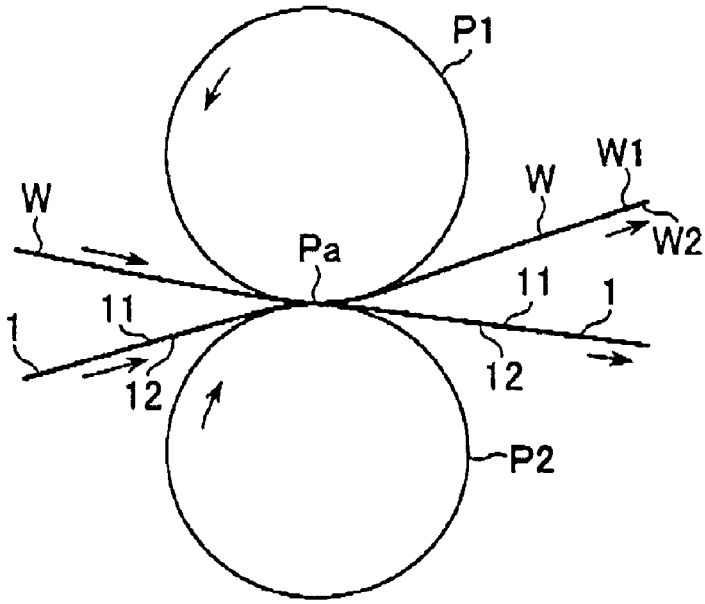
FIG. 8 is a cross-sectional view of the main part of a calender apparatus using an endless belt composed of an elastic material, and steel upper and lower rolls.

An alternative manufacturing method, in which a base body is disposed on a single roll R3, and a high molecular weight elastic material is spread over it, is depicted in FIG. 6. The method depicted in FIG. 6 is excellent for manufacturing a relatively short elastic belt. The procedure is similar to the procedure described with reference to FIG. 5 and the explanation in detail may be omitted.

In an elastic belt 10 according to the invention the bonding surface (or boundary) between the second high molecular weight elastic layer 12*b* which covers a paper sheet side 11*a* of the base body 11 and the third high molecular weight elastic material layer 14 which covers the press side 11*b* may be at various locations, optionally. For example, the bonding surface or boundary may be on the upper surface of a base body 11. Alternatively, the bonding surface or boundary may be at an intermediate location within the base body 11 relative to the direction of its thickness. In this case, it is desirable that filling yarn be inserted into the middle of the base body. The bonding surface or boundary may also be on the lower surface of a base body 11, or even spaced from the base body 11.

EXAMPLE 1

A second high molecular weight elastic layer 12*b* having a hardness of 85° (JIS-A), was formed by applying a polyurethane resin in which hollow microcapsules were mixed at a concentration of 1 wt % to the paper sheet side 11*a* of a base body 11 which was made of a triple weave woven fabric. A dense first high molecular weight elastic layer 12*a,* having a hardness of 90° (JIS-A) and formed of the same material (polyurethane), was formed on the second layer 12*b* to a thickness of 1 mm. After grinding, a third high molecular weight elastic layer, having a hardness of 90° (JIS-A), was formed by coating the press side 11*b* of the base body 11 with the same material (polyurethane), and an elastic belt according to the invention was obtained. In this case, the bonding surface, or boundary, of the second high molecular weight elastic material layer and the third high molecular weight elastic material layer was the upper surface of the base body 11.

EXAMPLE 2

A second high molecular weight elastic layer 12*b,* having a hardness of 80° (JIS-A), was formed by applying a polyurethane resin, in which hollow microcapsules were mixed at a concentration of 2 wt %, to the paper sheet side 11*a* of a base body 11. The base body was made of a triple weave woven fabric, and a dense first high molecular weight elastic layer 12*a* of isoprene rubber, having a hardness of 85° (JIS-A), and a thickness of 1 mm, was formed on the base body 11. After grinding, a third high molecular weight elastic layer, having a hardness of 85° (JIS-A), was formed by coating the press side 11*b* of the base body 11 with polyurethane resin, and an elastic belt according to the invention was obtained. In this case, the bonding surface or boundary of the second high molecular weight elastic material layer and the third high molecular weight elastic material layer was the upper surface of the base body 11.

EXAMPLE 3

A second high molecular weight elastic layer 12*b,* having a hardness of 80° (JIS-A), was formed by applying, to the paper sheet side 11*a* of a base body 11 made of a triple weave woven fabric, a polyurethane resin in which closed bubbles formed by a foaming agent, were mixed at a concentration of 15%. A dense first high molecular weight elastic layer 12*a,* of isoprene rubber, having a hardness of 85° (JIS-A), was formed on the second layer 12*b* to a thickness of 1 mm. After grinding, a third high molecular weight elastic layer, having a hardness of 85° (JIS-A), was formed by coating the press side 11*b* of the base body 11 with a polyurethane resin. In the elastic belt thus obtained, the bonding surface, or boundary, of the second high molecular weight elastic material layer and the third high molecular weight elastic material layer was the upper surface of the base body 11.

EXAMPLE 4

A second high molecular weight elastic layer 12*b,* having a hardness of 85° (JIS-A), was formed by applying, to the paper sheet side 11*a* of a base body 11 made of a triple weave woven fabric, a polyurethane resin in which microcapsules were mixed at a concentration of 2 wt %. A dense first high molecular weight elastic layer 12*a,* having a hardness of 90° (JIS-A), and made of the same material (polyurethane) was formed to a thickness of 1 mm on the second layer 12*b.* After grinding, a third high molecular weight elastic layer, having a hardness of 90° (JIS-A), was formed by coating the press side 11*b* of the base body 11 with the same material (polyurethane). In the elastic belt thus formed, the bonding surface, or boundary, of the second high molecular weight elastic material layer and the third high molecular weight elastic material layer was in the middle of the base body 11 in the direction of its thickness.

EXAMPLE 5

A second high molecular weight elastic layer 12*b,* having a hardness of 85° (JIS-A), was formed by applying to the paper sheet side 11*a* of a base body 11 made of a triple weave woven fabric, a polyurethane resin in which hollow microcapsules were mixed at a concentration of 2 wt %. A dense first high molecular weight elastic layer 12*a,* having a hardness of 90° (JIS-A), and made of the same material (polyurethane) was formed on the second layer 12*b* to a thickness of 1 mm. After grinding, a third high molecular weight elastic layer, having a hardness of 90° (JIS-A), was formed by coating the press side 11*b* of the base body 11 with the same material (polyurethane). In the elastic belt thus formed, the bonding surface, or boundary, of the second high molecular weight elastic material layer and the third high molecular weight elastic material layer was the upper surface of the base body 11.

COMPARATIVE EXAMPLE 1

A second high molecular weight elastic layer 12*b*, having a hardness of 85° (JIS-A), was formed by applying a polyurethane resin to the paper sheet side 11*a* of a base body 11 made of a triple weave woven fabric. A dense first high molecular weight elastic layer 12*a,* having a hardness of 90° (JTS-A), was made of the same material (polyurethane) and formed on the second layer 12*b* to a thickness of 1 mm. After grinding, a third high molecular weight elastic layer, having a hardness of 90° (JIS-A), was formed by coating the press side 11*b* of the base body 11 with the same material (polyurethane). In the elastic belt thus formed, the bonding surface or boundary of the second high molecular weight elastic material layer and the third high molecular weight elastic material layer was in the middle of the base body 11 in the direction of its thickness.

Figure 9:
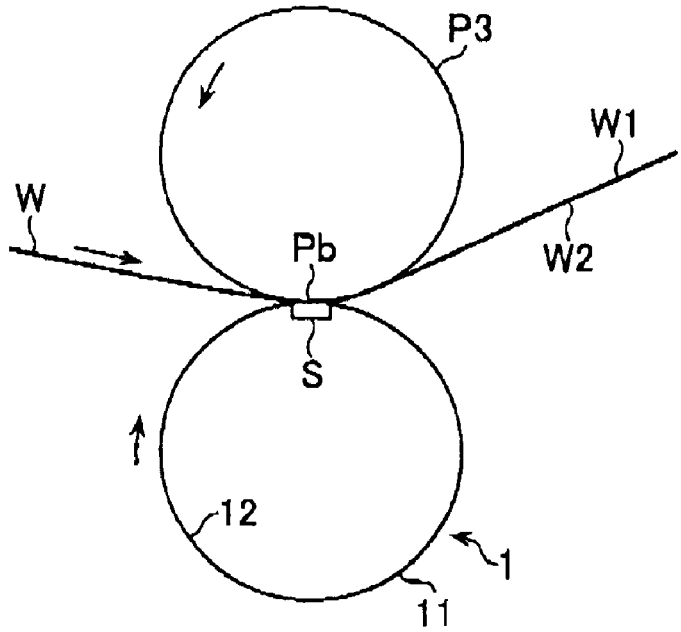
FIG. 9 is a cross-sectional view of the main part of a calender apparatus using an endless belt composed by an elastic material, a steel roll, and a press shoe.
Figure 10:
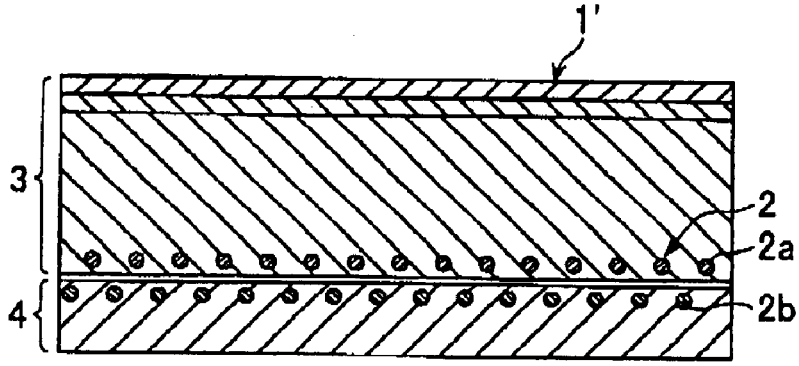
FIG.10 (PRIOR ART)
FIG. 10 is an enlarged cross-sectional view showing one conventional elastic belt.
Figure 11:
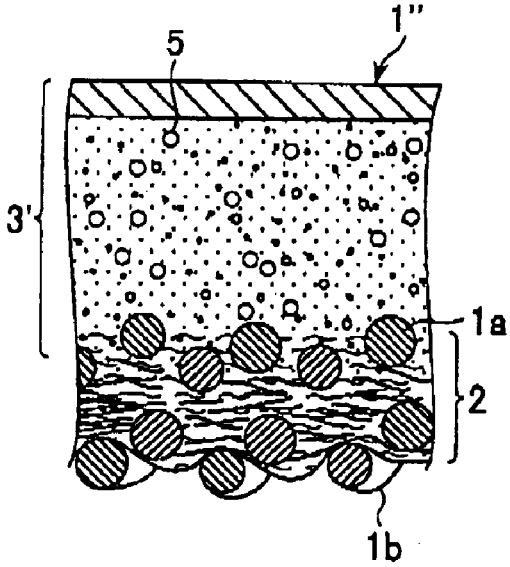
FIG.11 (PRIOR ART)
FIG. 11 is an enlarged cross-sectional view showing another conventional elastic belt.

For the elastic belts described above, calender effects, compression fatigue, and flex fatigue were evaluated using the calender apparatus shown in FIG. 9, and an overall evaluation was also determined. The results of the evaluations are shown in FIG. 7. Comparative example 1 is the same as Example 4 except that hollow microcapsules were not used in the comparative example.

According to the tabulation in FIG. 7, the evaluations of the calender effects, compression fatigue, and flex fatigue of Examples 1–5 included some 'fair' evaluations, but most were 'excellent' or 'good'. The comparative example on the other hand was evaluated as 'excellent' for compression fatigue and flex fatigue, but 'not good' for calender effects, and the overall evaluation of the comparative example was 'not good'.

The elastic belt for a papermaking calender in accordance with the invention, wherein the side of the base body which contacts the paper sheet is covered by a high molecular weight elastic layer composed of a dense first high molecular weight elastic layer and a second high molecular weight elastic layer having a multitude of small voids of almost the same size, produces highly desirable effects. Flexibility and excellent cushion properties are obtained due to the multitude of small voids of almost the same size in the middle layer, and its adaptability to the ruggedness of the paper sheet due to its dense surface layer.

Where the multitude of small voids in the high molecular weight elastic layer are composed of a hollow filler or hollow microcapsules mixed into the high molecular weight elastic material, the voids are of a stable size.

Where the small voids are bubbles are mixed into the high molecular weight elastic material by a bubble feeder, the multitude of small voids in the high molecular weight elastic layer are also of a stable size.

Likewise, where the small voids are bubbles which are produced by the action of a foaming agent mixed into the high molecular weight elastic material, the small voids in the high molecular weight elastic layer are also of a stable size.

Where the first high molecular weight elastic layer has a hardness of 85 to 95° (JIS-A) and the second high molecular weight elastic member has a hardness either equal to that of the first layer or a hardness in the range of 80 to 85° (JIS-A), the hardness of the surface layer and the internal layer are properly balanced.

Where the press side of the belt, i.e., the side opposite to the paper sheet side of the base body, is exposed, reduced manufacturing cost can be realized.

On the other hand, when the press side of the base body is covered by a third, high molecular weight elastic layer, good durability of the press side, and its impermeability to oil supplied to the inside of the belt, may be achieved simultaneously.

Finally, where the third high molecular weight elastic layer has a hardness of 85 to 95° (JIS-A), superior durability of the part which contacts the press side, and impermeability to oil supplied to the inside of the belt may be achieved.

What is claimed is:

1. An elastic belt for a papermaking calender comprising a base body having a paper side and a press side opposite to the paper side, and a high molecular weight elastic layer covering the paper side of the base body, wherein the high molecular weight elastic layer is composed of a first, high molecular weight elastic layer, and a second layer located between said first layer and the base body, the second layer consisting of a high molecular weight elastic material and a plurality of voids consisting of hollow particles mixed with the second high molecular weight elastic material, wherein said first high molecular weight elastic layer has a hardness of 85 to 95° (JIS-A), and wherein said second layer has a hardness in the range from 80° (JIS-A) to a hardness equal to the hardness of said first high molecular weight elastic layer.

2. An elastic belt for a papermaking calender as claimed in claim 1, wherein the press side of said base body is exposed.

3. An elastic belt for papermaking calender as claimed in claim 1, wherein the press side of said base body is covered by a third high molecular weight elastic layer.

4. An elastic belt for a papermaking calender as claimed in claim 3, wherein said third high molecular weight elastic layer has a hardness of 85 to 95° (JIS-A).

5. An elastic belt for a papermaking calender as claimed in claim 1, wherein the void content of said second high molecular weight layer is in the range from 2 to 30%.

6. An elastic belt for a papermaking calender as claimed in claim 1, wherein the second high molecular weight layer is composed of a resin, and hollow microcapsules present in the resin in a range from 0.5 to 50 wt. %.

7. An elastic belt for a papermaking calender as claimed in claim 1, wherein the diameters of the voids in the second high molecular weight elastic layer are in the range from 10 to 100 $\mu$m.

8. An elastic belt for a papermaking calender as claimed in claim 1, wherein the voids in the second high molecular weight elastic layer are of substantially uniform size.

9. An elastic belt for a papermaking calender as claimed in claim 1, wherein said hollow particles are selected from the group consisting of a hollow filler and hollow microcapsules.

* * * * *